US008113245B2

(12) United States Patent
Federzoni et al.

(10) Patent No.: US 8,113,245 B2
(45) Date of Patent: Feb. 14, 2012

(54) DEVICE FOR FILLING A CONTAINER WITH AT LEAST ONE TYPE OF POWDER MATERIAL

(75) Inventors: Luc Federzoni, Bourgoin-Jallieu (FR); Pascal Revirand, Saint Egreve (FR)

(73) Assignee: Commissariat A l'Energie Atomique, Paris (FR)

( * ) Notice: Subject to any disclaimer, the term of this patent is extended or adjusted under 35 U.S.C. 154(b) by 1159 days.

(21) Appl. No.: 11/813,636

(22) PCT Filed: Jan. 24, 2006

(86) PCT No.: PCT/FR2006/050046

§ 371 (c)(1),
(2), (4) Date: Jul. 10, 2007

(87) PCT Pub. No.: WO2006/079740

PCT Pub. Date: Aug. 3, 2006

(65) Prior Publication Data

US 2008/0053562 A1 Mar. 6, 2008

(30) Foreign Application Priority Data

Jan. 27, 2005 (FR) ..... 05 50233

(51) Int. Cl.
*B65B 31/00* (2006.01)

(52) U.S. Cl. ..... 141/61; 141/7; 141/52

(58) Field of Classification Search ..... 141/4, 7, 141/8, 52, 57, 59, 61, 65, 285; 425/84; 264/86, 264/109, 113, 121, 122; 406/122, 145
See application file for complete search history.

(56) References Cited

U.S. PATENT DOCUMENTS

| | | | | |
|---|---|---|---|---|
| 2,170,469 | A * | 8/1939 | Carter | 141/7 |
| 2,608,335 | A * | 8/1952 | Rohdin | 141/59 |
| 2,613,864 | A * | 10/1952 | Carter | 141/49 |
| 3,421,554 | A * | 1/1969 | Carter | 141/7 |
| 4,081,004 | A | 3/1978 | Harris | |
| 4,084,390 | A * | 4/1978 | Schmachtel et al. | 53/511 |
| 4,185,669 | A * | 1/1980 | Jevakohoff | 141/59 |
| 4,813,818 | A * | 3/1989 | Sanzone | 406/122 |
| 4,872,493 | A * | 10/1989 | Everman | 141/59 |
| 4,967,814 | A * | 11/1990 | Day, Jr. | 141/286 |
| 4,976,296 | A * | 12/1990 | Pope | 141/46 |
| 5,194,268 | A * | 3/1993 | Bradley et al. | 425/84 |
| 5,244,019 | A * | 9/1993 | Derby | 141/65 |
| 6,315,011 | B1 | 11/2001 | Smith | |

(Continued)

FOREIGN PATENT DOCUMENTS

DE 29 24 313 12/1980

(Continued)

*Primary Examiner* — Timothy L Maust
(74) *Attorney, Agent, or Firm* — Oblon, Spivak, McClelland, Maier & Neustadt, L.L.P.

(57) ABSTRACT

A device for filling a recipient with at least one material in a form of a powder, the device including: a filling channel configured to bring the material from a reserve of material to an entry opening of the recipient; and a pump that evacuates a pneumatic fluid contained in the recipient through at least one first evacuation duct and a second evacuation duct, wherein the at least one first evacuation duct is configured to connect an inside of the recipient to an environment outside of the recipient during a filling phase, the first evacuation duct being internal to the filling channel, and the second evacuation duct is configured to evacuate the pneumatic fluid before filling.

15 Claims, 4 Drawing Sheets

U.S. PATENT DOCUMENTS

| | | | | |
|---|---|---|---|---|
| 6,770,232 | B2 * | 8/2004 | Prodi | 264/113 |
| 2003/0113222 | A1 | 6/2003 | Skoglund et al. | |
| 2007/0071632 | A1 | 3/2007 | Revol | |

FOREIGN PATENT DOCUMENTS

| | | | |
|---|---|---|---|
| DE | 3310725 | A1 | 9/1984 |
| EP | 0 032 481 | A2 | 7/1981 |
| EP | 0 155 736 | A1 | 9/1985 |
| EP | 0 352 981 | A1 | 1/1990 |
| FR | 2 234 045 | | 1/1975 |
| JP | 62-122902 | | 6/1987 |
| JP | 7-125702 | | 5/1995 |
| WO | WO 2006/079740 | A1 | 8/2006 |
| WO | WO 2006/085035 | A1 | 8/2006 |

* cited by examiner

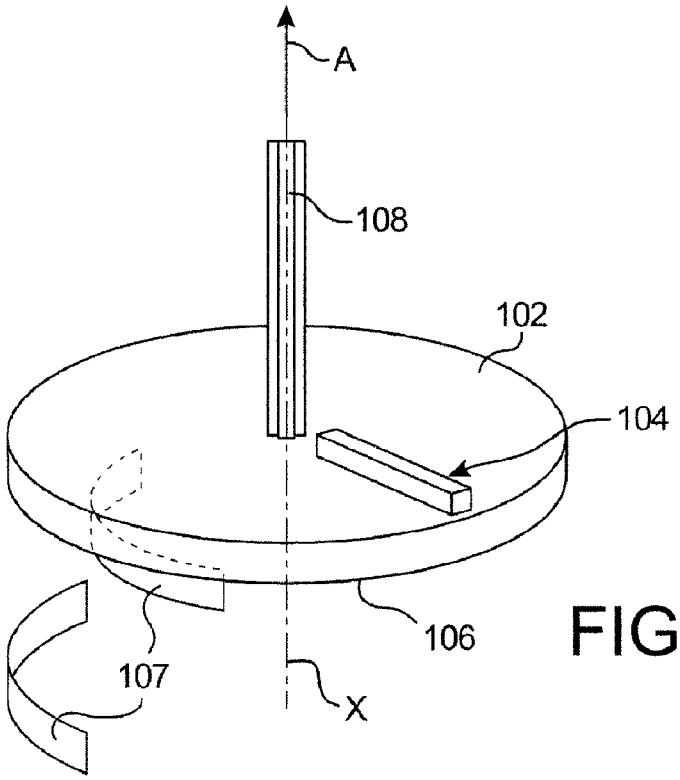
FIG.7
FIG.7a
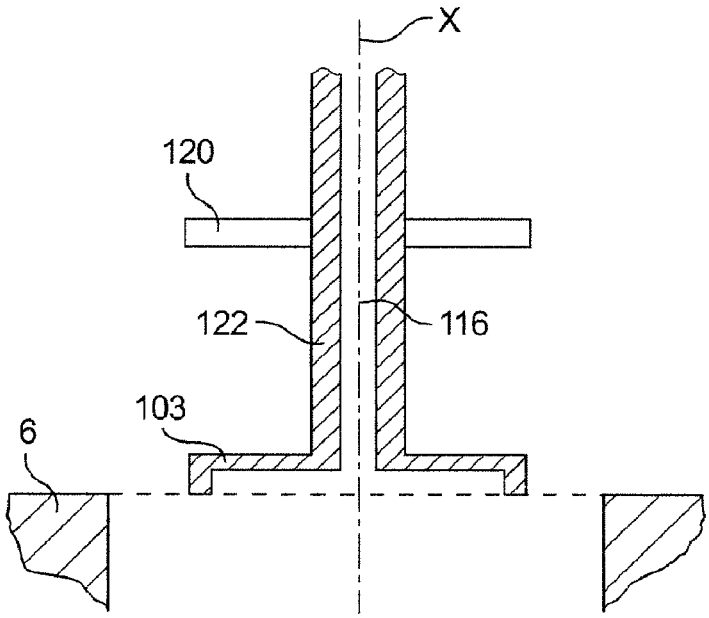
FIG.8

DEVICE FOR FILLING A CONTAINER WITH AT LEAST ONE TYPE OF POWDER MATERIAL

TECHNICAL FIELD AND PRIOR ART

This invention relates mainly to a method for filling a recipient with at least one powdered material, and a device or implementing said method.

The materials the form of powder are very numerous, for example washing powders, powdered milk or cement. In industry, materials in the form of powder intended to be put into form for example by sintering, by pressing, by pressing-sintering or by hot isostatic pressing are concerned. These are for example metallic or ceramic powders, or a mix of them. It is possible to obtain parts with very complex geometry.

However, it has appeared that the air present in the mould before filling is likely to render the filling non homogenous, at the origin of porosities in the moulded part, to lead to low and dispersed apparent densities, and increase filling time. Furthermore, the presence of air is likely to disturb the flow of the powdery material in the mould.

US 2003/0113222 discloses a device allowing air to be injected into the powdery material at the time the mould is filled in order to homogeneously distribute the various sizes of material particles. However nothing is provided to overcome the problem of the air contained in the mould.

It is consequently an objective of this invention to offer a device for filling a recipient ensuring a homogenous distribution of the powdery material in the recipient.

It is also an objective of this invention to offer accelerated filling of the recipient.

It is also an objective of this invention to offer a sure and fast method of filling with materials in the form of powder.

DISCLOSURE OF THE INVENTION

These objectives are reached by a filling device equipped with at least one ventilating duct of a mould intended to be filled using said device.

In other terms, before filling and/or during filling, ducts are provided to allow the air to escape from the mould and to leave room for the powder, or to be drawn out of the mould, a slight suction accelerating the filling is then generated.

The main object of this invention is a device for filling a recipient with at least one substance in the form of powder, said device comprising a filling channel intended to bring the material from a reserve of material to an entry opening of the recipient characterised in that it also comprises means to evacuate a pneumatic fluid contained in said recipient.

In particular, the means of evacuation comprise at least one duct intended to connect the inside of the recipient to an environment outside of the recipient during the filling phase, called the first duct and/or a duct intended to evacuate the air before filling, called the second duct. Advantageously, the second evacuation duct is connected to the first duct.

In a preferred embodiment, the first evacuation duct is internal to the filling channel.

Advantageously, a means of aspiration of the air contained in the recipient is connected to the first and/or the second duct.

In a first example of embodiment, the means of aspiration is a pneumatic pump.

In the case where the first evacuation duct is internal to the filling channel, the first duct can be connected to the pump by at least two secondary ducts, advantageously three, distributed angularly in a regular manner around the first duct.

In a second example of the embodiment, said means of aspiration is mounted in the filling channel and is formed by at least one blade mounted on a lower side of a disc intended to be drawn in rotation on its axis, said disc comprising in its central part an opening connected to the first evacuation duct.

At least one element of distribution of the powdered material in the recipient projecting from an upper side of the disc can also be provided.

The filling device can also comprise a cylindrical core positioned axially below the plate and comprising a third evacuation duct faced to the first duct and emerging in the upper part of the recipient by at least one secondary duct.

Advantageously, the device comprises several secondary ducts distributed angularly in a regular manner around the third duct.

According to another example of carrying out the filling device according to this invention, the aspiration disc and a distribution disc distinct from the aspiration disc and positioned before the aspiration disc in the direction of filling of the material, are affixed in rotation to a shaft able to be drawn in rotation and wherein is made the first evacuation duct.

According to an embodiment, the filling device is in the form of a shoe intended to slide on a table comprising an opening connected to the entrance of a recipient.

The device according to this invention is notably intended to fill at least one mould in order to manufacture parts by sintering, by pressing, by pressing-sintering or by hot isostatic pressings.

The object of this invention is also a method for filling a recipient with at least one powdered material comprising among others the step of evacuating the air contained in the recipient when putting the powdered material in place and/or prior to putting said material in place.

BRIEF DESCRIPTION OF THE DRAWINGS

This invention shall be better understood using the description that follows and the drawings in the annexes for which the upper and lower part are respectively the top and the bottom of the drawings.

FIG. 7 is an isometric perspective view of a detail in FIG. 6.

FIG. 7*a* is a detailed view of FIG. 7.

FIG. 8 is a longitudinal cross-section view of another example of the second embodiment.

DETAILED DISCLOSURE OF PARTICULAR EMBODIMENTS

Figure 1:
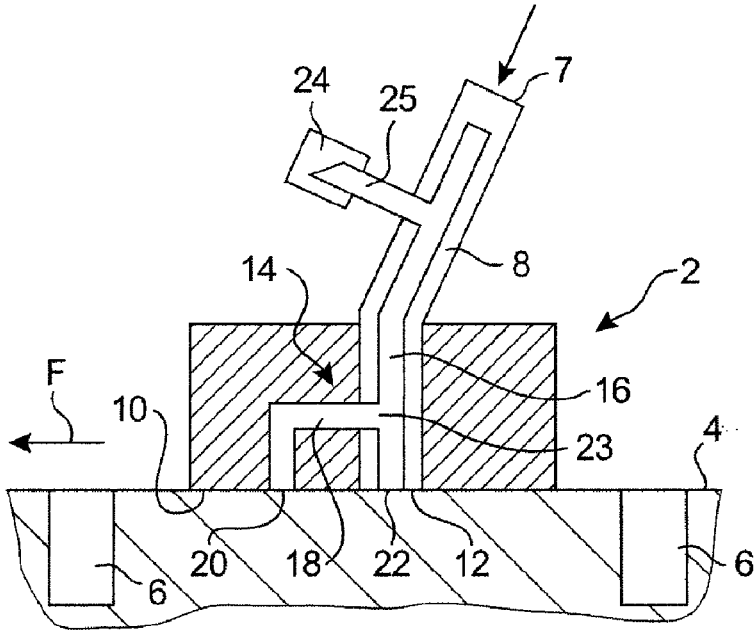
FIG. 1 is a schematic representation of a first example of a filling device according to this invention.

In FIG. 1, a first example can be seen of a first embodiment of a filling device according to this invention comprising a shoe 2 so-called a filling shoe intended to slide along arrow F on a table 4 wherein cavities 6 are made to be filled, for example moulds. The shoe comprises a filling channel 8 connected to a reserve of powdery material (not shown) by an upper end 7, channel 8 emerges in a lower part 10 or plate intended to be in contact with table 4, by an outlet opening 12 by which the powdery material flows into recipient 6.

According to this invention, the shoe also comprises means 14 allowing a pneumatic fluid contained in recipient 6, for example air to be evacuated from the recipient. In the example shown, means 14 comprise a first duct 16 intended to allow the evacuation of the air from the recipient 6 during filling, i.e. when the powdered material penetrates into the cavity.

Figure 2:
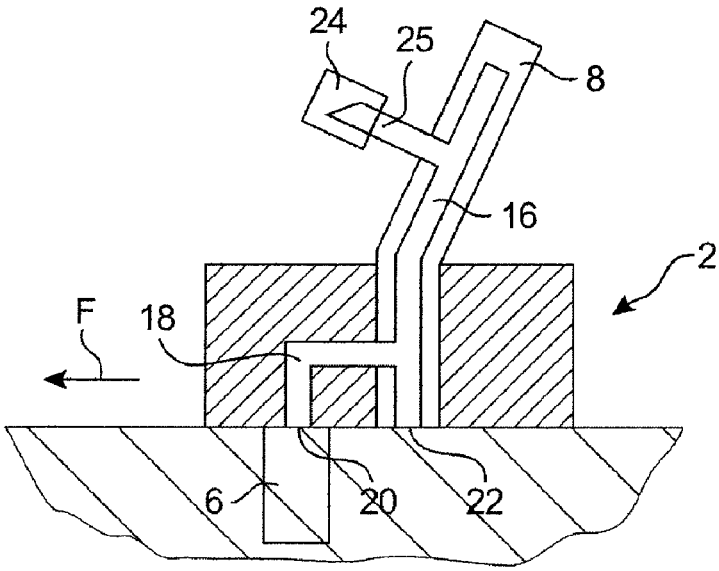
FIG. 2 is a schematic representation of the device in FIG. 1 in a phase prior to filling.

The device also comprises advantageously a second evacuation duct 18 intended to allow the air to exit the recipient 6 before filling begins (FIG. 2). But it is of course understood, that an evacuation of the air only before filling or only during filling does not fall outside the scope of this invention.

In the example shown, the first duct 16 is positioned inside the filling channel in a substantially coaxial manner in order to not disturb uniform flow of the material in channel 8. The first duct 16 emerges by a first lower end 22 in the outlet opening 12 of channel 8. The second duct 18 is made directly in the shoes and emerges by a first end 20 before end 22 in the direction of arrow F, in soleplate 10 of the shoe and by a second end 23 in the first duct 16.

The position of the first duct inside the filling duct in a manner that is substantially coaxial to the latter, allow in a most advantageous manner to obtain an extraction of pneumatic fluid with a symmetry of revolution. Indeed, the first aspiration duct 16 emerges in a substantially central part of the recipient, which makes it possible to draw the air in the entire recipient all around the duct, without favouring any specific zone of the recipient.

In this way, the appearance of a disturbance in the flow of the powder and therefore in the filling of the mould is avoided. This thus results in filling of the mould that is even more homogenous.

Furthermore, this embodiment allows for a simple adaptation of the filling device to different types of powder. Indeed, it can be desirable to modify the aspiration according to the granulometry of the powder, by modifying the rate of aspiration. The increase or decrease of the rate of aspiration can do simply by replacing the first duct 16, by a first duct with a larger section or with a smaller section respectively. With devices of the prior art, wherein aspiration is carried out by the outside of the filling duct, this modification is on the contrary cumbersome and restricting.

The air is evacuated by a second upper end 25 of the first duct 16 outside the filling channel. Duct 16 crosses, in the embodiment shown, the periphery of the channel or tube 8. Advantageously, connection of duct 16 with the outside environment is made by at least two secondary tubes arranged symmetrically in relation to the axis of duct 16, so as to disturb as little as possible the flow symmetry of the powder downstream form the bifurcation of duct 16. More preferably, it entails three secondary ducts distributed angularly in a regular manner at 120° or six secondary ducts at 60° around the axis of the channel.

It is of course understood that a first and a second duct could be provide that are entirely independent and connected to the outside environment independently.

Advantageously, in order to extract the air contained in the recipient before and during filling, a pneumatic pump 24 is provided connected to the upper end of the first duct 16 and able to extract the air contained in the recipient. It is of course understood that it is possible to consider a pump extracting the air from the recipient only before filling, either by providing first 16 and second 18 ducts that are entirely separated or by activating the pump only prior to filling. The use of this pump has the advantage of accelerating the filling speed due to the aspiration generated by the pump inside the recipient.

The pump is advantageously connected to the first duct 16 by means of a flexible hose, which adapts to the travel of the shoe.

Pneumatic pump 24 generates, for example a depression of $10^5$ Pa, which is sufficient to obtain good flow performance without drawing powder into the air extraction ducts.

Advantageously, in the embodiment comprising a pneumatic pump, filters can be provided positioned at the level of lower ends 22 and 20 respectively of the first 16 and second 18 ducts, forming barriers for the powdered material in order to avoid it being drawn by ducts 16 and 18.

It is of course understood that a device comprising several ducts 16 and/or 18 to extract the air from the cavity to be filled does not fall outside the scope of this invention.

We shall now describe the process of filling a recipient 6.

In FIG. 2, the first end 20 of the second duct 18 faces to recipient 6, the air contained in the recipient 6 is drawn and evacuated towards the outside.

Figure 3:
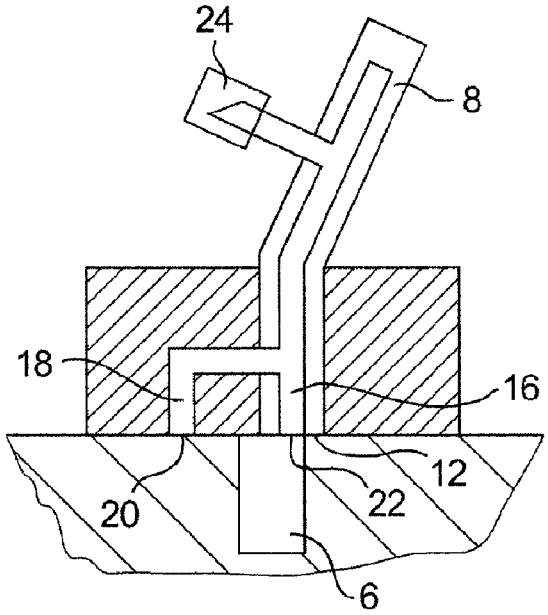
FIG. 3 is a schematic representation of the device in FIG. 1 at the start of filling.

The shoe continues to move in the direction of arrow F (FIG. 3), the outlet opening 12 faces to recipient 6, filling begins, the powder flows into the recipient. The first duct 16 communicates with the interior of the recipient 6, the air is evacuated either naturally (the air is driven out due to the arrival of the powder), or by aspiration.

Figure 4:
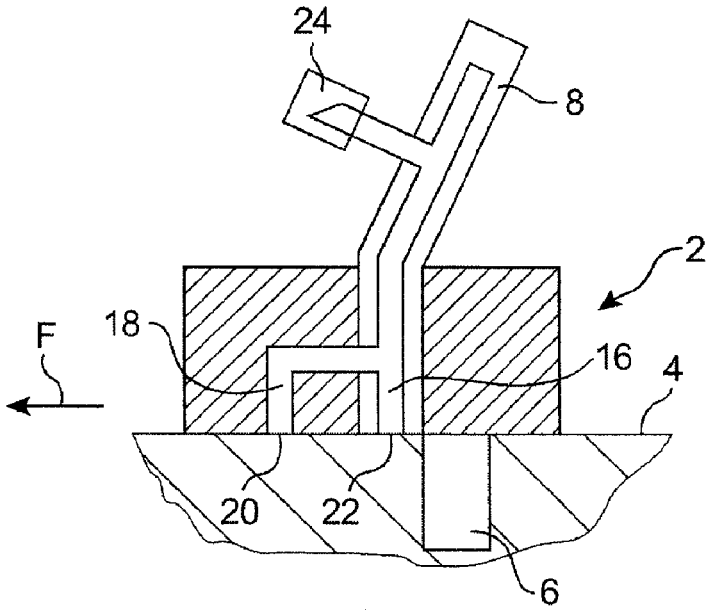
FIG. 4 is a schematic representation of the device in FIG. 1 at the end of filling.

In FIG. 4, the shoes has again travelled in the direction of arrow F, the outlet opening will soon exceed the entrance of recipient 6. Filling is soon finished.

When the outlet opening 12 has completely exceeded the entrance of the recipient, filling is interrupted.

Figure 5:
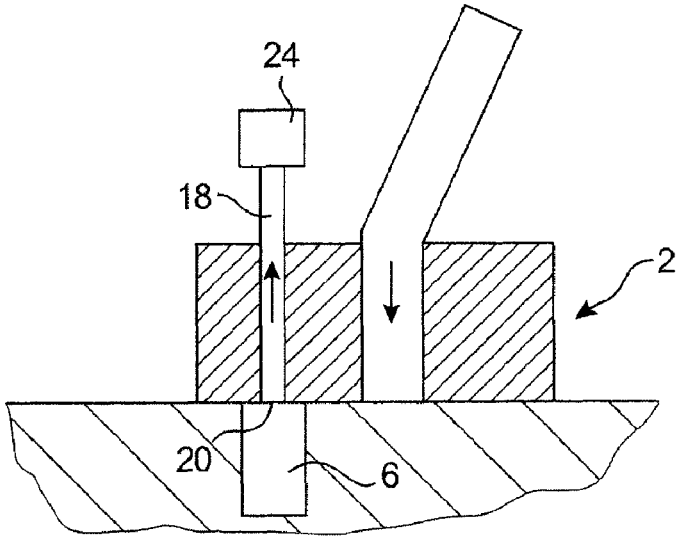
FIG. 5 is a schematic representation of a second example of a filling device according to this invention.

In FIG. 5, a second example of embodiment can be seen, wherein shoe 2 comprises a distinct filling channel 8 and air evacuation duct 18, duct 18 making it possible to evacuate the air before filling, when its lower end 20 is facing to the filling cavity. Advantageously, evacuation duct 18 is connected to a pneumatic pump 24. Evacuation duct 18 forms the second duct such as described previously.

Figure 6:
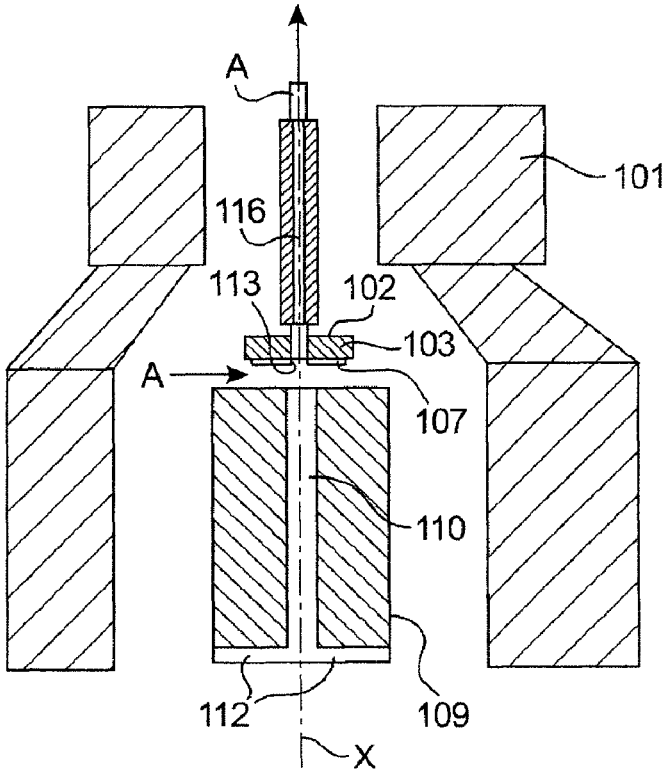
FIG. 6 is a cross-section view of a second embodiment of a device according to this invention.

In FIGS. 6 and 7, a first example can be seen of a second embodiment of a device according to this invention wherein the powdered material is distributed homogenously by the rotation of a part of the filling device.

The filling device according to the second embodiment comprises a cylindrical shell 101 intended to be positioned above a recipient to be filled (not shown) and forming a filling channel between a powder reservoir and the recipient. The device also comprises a means of distribution 100, positions in the filling channel and formed by a plate 103 of the X axis, intended to be put into rotation around this X axis. In the example shown, the disc is equipped on an upper face 102 with at least one distribution element 104 extending substantially radially on the plate, in the form of a small bar. Small bar 104 is intended to homogeneously distribute the powder carried by a hopper placed above the filling device (not shown). It is of course understood that element 104 can have any form adapted to distribute the powder.

The device also contains on a lower face 106 of disc 103 at least one air aspiration blade 107 (as a dotted line) intended to provoke a vortex in order to evacuate the air contained in the recipient to be filled. Plate 103 is drawn into rotation by the intermediary of an axis shaft 108 coaxial to axis X wherein is practised a first evacuation duct 116 of the air drawn by scoop 107. An opening 113 is practised in the central part of the disc on the side of the lower side 106 in order to bring into communication the space located below the disc and the first duct 116. So, during filling, simultaneously to the uniform distribution of the powder around the X axis in the mould, the air is drawn according to the path indicated by arrows A.

In the example shown, the aspiration blade substantially has the form of a turbine blade adapted to generate a depression. But it is of course understood that it can have other forms.

The device according to this invention also comprises a central core 109 with the form of a regular cylinder positioned axially below the plate and also equipped with a third aspiration duct 110 positioned to the right of the first extraction duct 116, so as to draw the air contained in the bottom of the recipient. Aspiration duct 110 in its lower part advantageously separates into several secondary ducts 112 distributed angularly in a regular manner around the axis of the aspiration duct 110 so as to have uniform drawing of air in the mould.

We shall now explain the operation of such a device.

In a first step, the device is positioned above the recipient.

In a second step, disc 103 is put into rotation, in particular blade 106, the air contained in the recipient is then drawn by ducts 112, 110 and 109 in the direction of the arrow.

In a third step, the hopper is opened in order to allow the flow of the load of powder that it contains, into the filling duct and in particular on the plate. Due to the rotation of the plate and the small distribution bar, the powder is ejected uniformly against the walls of the filling channel and falls into the recipient. Simultaneously to filling, the air continues to be evacuated.

In FIG. 8, we can see a second example of the second embodiment of a filling device according to this invention. Said device comprises distinct distribution plate 120 and aspiration plate 103, with aspiration plate 103 being intended to be positioned near the filling opening of recipient 6 and distribution plate 120 above aspiration plate 103. The two plates are connected in rotation to a shaft 122 able to be drawn into rotation around the X axis, and pierced with a first longitudinal evacuation duct 116, emerging by an end in a lower side of the aspiration disc 103 and by another end in the outside environment.

During a filling phase, the shaft is set to rotate, provoking an aspiration of the air contained in the recipient.

Then the material is flowed on the distribution disc that distributes the material in the recipient, the aspiration disc continues to draw the air in the recipient.

In this embodiment, the first air evacuation duct during filling and the second air evacuation duct before filling are combined.

This invention therefore has the advantage of resulting in a better homogeneity of the filling of the mould. So, for an axisymmetric part, it makes it possible to ensure better circumferential distribution of powder density.

In addition, the device according to this invention allows to yield reduced filling times compared to known types of systems. In mass production, the savings in time obtained during filling results in substantial gains in productivity.

This invention is also very advantageous in the case of filling with ultra fine powders. Indeed, fine powders, such as micrometric powders of the Sm—Co type are difficult to manipulate with filling systems of the known type, since the presence of air in the matrix disturbs the flow of the powder during its fall into the cavity to be filled.

This invention results in performance that is close to that obtained with a vacuum filling system. But the implementation of vacuum filling cannot be carried out in an industrial environment.

This invention in particular applies to filling the mould with a powder or mixture of powders for the achievement of parts by sintering, by pressing, by pressing-sintering or by hot isostatic pressing.

But it is of course understood that the filling device according to this invention makes it possible to uniformly fill any type of recipient with a material in the form of powder.

The invention claimed is:

1. A device for filling a recipient with at least one material in a form of a powder, the device comprising:

a filling channel configured to bring the material from a reserve of material to an entry opening of the recipient; and means for evacuating a pneumatic fluid contained in the recipient, the means for evacuating including at least one first evacuation duct configured to connect an inside of the recipient to an environment outside of the recipient during a filling phase, the first evacuation duct being internal to the filling channel, and the means for evacuating further including a second evacuation duct configured to evacuate the pneumatic fluid before filling, the first evacuation duct including an end configured to face the opening of the recipient and the second evacuation duct including an end configured to face the opening of the recipient, the end of the first evacuation duct being distinct from the end of the second evacuation duct.

2. A filling device according to claim 1, wherein the second evacuation duct is connected to the first evacuation duct.

3. A filling device according to claim 1, further comprising an aspirator of air contained in the recipient and connected to the first and/or to the second evacuation ducts.

4. A filling device according to claim 2, further comprising an aspirator of air contained in the recipient and connected to the first and/or to the second evacuation ducts.

5. A filling device according to the claim 3, wherein the aspirator includes a pneumatic pump.

6. A filling device according to claim 4, wherein the aspirator includes a pneumatic pump.

7. A filling device according to claim 5, wherein the first evacuation duct is connected to the pneumatic pump by at least two or three secondary ducts, distributed angularly in a regular manner around the first evacuation duct.

8. A filling device according to claim 6, wherein the first evacuation duct is connected to the pneumatic pump by at least two or three secondary ducts, distributed angularly in a regular manner around the first evacuation duct.

9. A filling device according to claim 1, the device having a form of a shoe configured to slide on a table including an opening connected to the entrance of a recipient.

10. A filling device according to claim 1 configured to fill at least one mold to manufacture parts by sintering, by pressing, by pressing-sintering, or by hot isostatic pressings.

11. A filling device according to claim 1, wherein the second evacuation duct is configured to evacuate the pneumatic fluid from the recipient without the pneumatic fluid passing through the end of the first evacuation unit that faces the opening of the recipient.

12. A filling device according to claim 1, wherein first evacuation duct and the second evacuation duct are configured so that the pneumatic fluid is evacuated through only one of the first evacuation duct and the second evacuation duct at a time.

13. A device for filling a recipient with at least one material in a form of a powder, the device comprising:

a filling channel configured to bring the material from a reserve of material to an entry opening of the recipient; and a pump that evacuates a pneumatic fluid contained in the recipient through at least one first evacuation duct and a second evacuation duct, wherein the at least one first evacuation duct is configured to connect an inside of the recipient to an environment outside of the recipient during a filling phase, the first evacuation duct being internal to the filling channel, the second evacuation duct is configured to evacuate the pneumatic fluid before filling, the first evacuation duct including an end configured to face the opening of the recipient and the second evacuation duct including an end configured to face the opening of the recipient, the end of the first evacuation duct being distinct from the end of the second evacuation duct.

14. A filling device according to claim 13, wherein the second evacuation duct is configured to evacuate the pneumatic fluid from the recipient without the pneumatic fluid passing through the end of the first evacuation unit that faces the opening of the recipient.

15. A filling device according to claim 13, wherein first evacuation duct and the second evacuation duct are configured so that the pneumatic fluid is evacuated through only one of the first evacuation duct and the second evacuation duct at a time.

* * * * *